US010431190B2

(12) United States Patent
Grbinick

(10) Patent No.: US 10,431,190 B2
(45) Date of Patent: Oct. 1, 2019

(54) DUAL SHELL DRUM

(71) Applicant: Joshua Grbinick, Tacoma, WA (US)

(72) Inventor: Joshua Grbinick, Tacoma, WA (US)

( * ) Notice: Subject to any disclaimer, the term of this patent is extended or adjusted under 35 U.S.C. 154(b) by 0 days.

(21) Appl. No.: 15/747,575

(22) PCT Filed: Aug. 11, 2016

(86) PCT No.: PCT/US2016/046472
§ 371 (c)(1),
(2) Date: Jan. 25, 2018

(87) PCT Pub. No.: WO2017/027662
PCT Pub. Date: Feb. 16, 2017

(65) Prior Publication Data

US 2018/0211641 A1 Jul. 26, 2018

Related U.S. Application Data

(60) Provisional application No. 62/203,678, filed on Aug. 11, 2015.

(51) Int. Cl.
*G10D 13/00* (2006.01)
*G10D 13/02* (2006.01)

(52) U.S. Cl.
CPC ..... *G10D 13/028* (2013.01)

(58) Field of Classification Search
CPC ..... G10H 2230/285; G10H 1/32; G10H 2230/275; G10H 2230/291; G10H 2230/281; G10H 2230/305; G10H 2230/295
See application file for complete search history.

(56) References Cited

U.S. PATENT DOCUMENTS 4,993,304 A * 2/1991 Lovelet ..... G10D 13/028 84/411 R
5,600,080 A * 2/1997 Belli ..... G10D 13/026 84/421
6,291,752 B1 * 9/2001 Vergara ..... G10D 13/028 84/104
2012/0000343 A1 * 1/2012 Rothenberg ..... G10D 13/00 84/421
2014/0202310 A1 * 7/2014 Tahour ..... G10D 13/021 84/412
2016/0140938 A1 * 5/2016 Takegawa ..... G10D 13/023 84/413

* cited by examiner

*Primary Examiner* — Marlon T Fletcher
(74) *Attorney, Agent, or Firm* — FisherBroyles LLP; Kevin D. Jablonski

(57) ABSTRACT

The present invention provides a dual shell drum compact in depth, and thus is less cumbersome, more easily transportable, and has a better range of positioning options, than conventional drums. Further, the dual shell drum of the invention provides a broader tonal range and superior sound projection compared to conventional single shell drums.

19 Claims, 8 Drawing Sheets

DUAL SHELL DRUM

FIELD OF THE INVENTION

The present invention relates to percussion instruments and, in particular, to dual shell drums which are compact, easily transportable, and have superior tonal ranges and sound projection compared to conventional drums.

BACKGROUND OF THE INVENTION

Conventional drums, also referred to as membranophones, are comprised of the following parts: a single cylindrical shell of any diameter; two membranes, referred to as heads, tensioned on the top side (i.e., batter) and bottom side (i.e., resonator) of the cylindrical shell; two rims which hold the heads in place via lug screws, also known as tension rods; and four or more lugs attached to the drum shell that provide tension to the heads via the lugs screws.

The size of drums typically is stated in inches as depth× diameter, with tom-tom drum dimensions having, for example, the following exemplary dimensions: 8×12 and 9×12, 8×10, 9×12, 10×139×10, 10×12, 11×13, etc. Power toms typically are one inch deeper than these aforementioned sizes and include, for example, 9×10, 10×10, 11×12 and 12×13.

Conventional drum sets are comprised of an indeterminate number of tom drums, one or more snare drums, and one or more bass drums (i.e., kick drums). With respect to the size of drums, drummers generally desire larger drums for their sound quality, i.e., tone and projection; and desire smaller drums for their ease of transport. Smaller drums, however, typically have inferior sound tone and projection compared to larger drums. In addition, larger single shell conventional drums have dimensions which make set-up, break-down and transport of drum sets difficult and cumbersome.

There exists a need, therefore, for less cumbersome drums so that set-up, break-down and transport of the drums are easier, while at the same time not sacrificing the quality and projection of sound of the drums.

SUMMARY OF THE INVENTION

The present invention fulfills this need by providing a dual shell drum that is compact, and thus much less cumbersome and more easily transportable, as well as having a better range of positioning options compared to conventional single shell drums. Further, the dual shell drum design of the invention provides a broader tonal range and superior sound projection compared to conventional single shell drums.

The compact, easily transportable dual shell drum of the invention is comprised of an outer shell and an inner shell suspended atop but not touching the outer shell. The outer shell has an inner side, an outer side, a top end and a bottom end, and the inner shell has an inner side, an outer side, a top end and a bottom end. The outer shell and the inner shell each have an opening on their top end and their bottom end, the opening of the outer shell defining an outer shell interior therein, and the opening of the inner shell defining an inner shell interior therein.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

Figure 1:
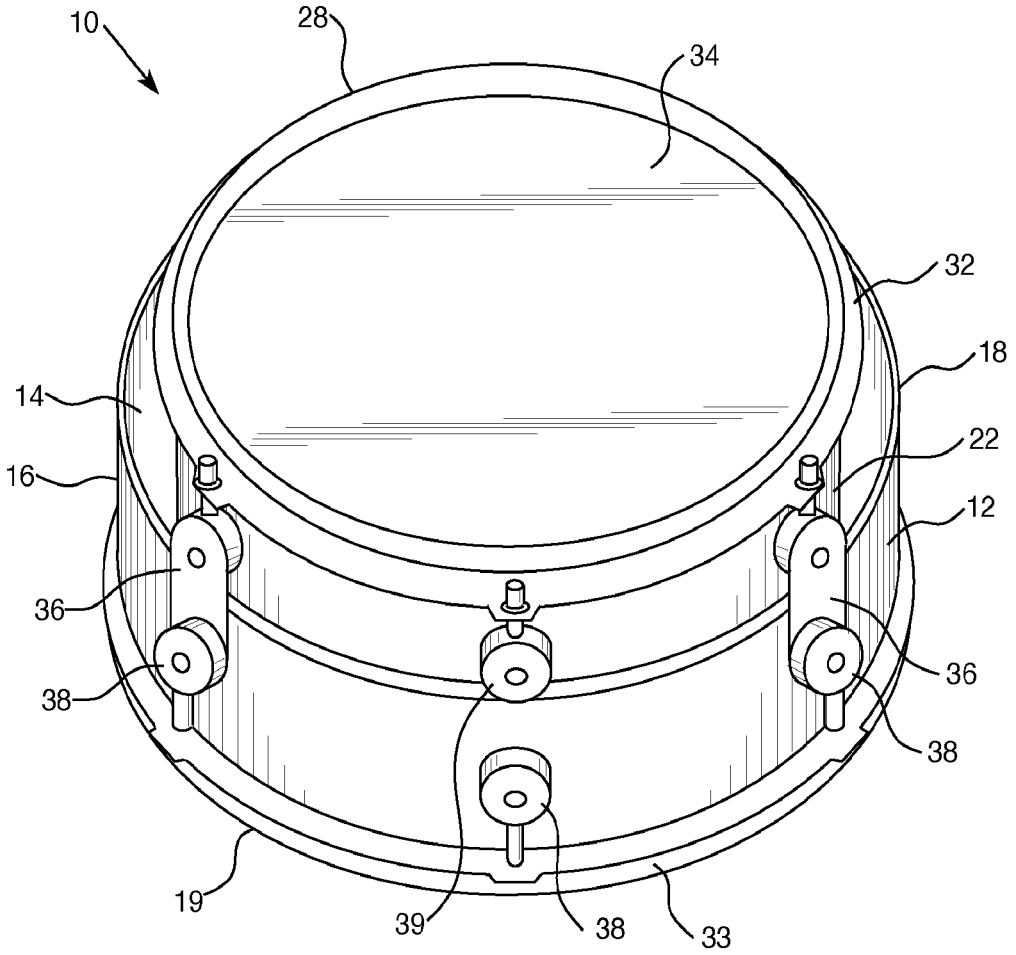
FIG. 1 is a perspective view of the dual shell drum which is fully assembled having six lugs evenly spaced apart, in accordance with the embodiments of the invention.

A complete understanding of the present invention will be obtained from the following description taken in connection with the accompanying drawing figures, wherein like reference characters identify like parts throughout.

Referring now to FIGS. 1-6, the dual shell drum 10 of the invention comprises an outer shell 12 and an inner shell 22. The outer shell 12 has an inner side 14, an outer side 16, a top end 18 and a bottom end 19. The inner shell 22 has an inner side 24, an outer side 26, a top end 28 and a bottom end 30 (seen in FIG. 6). Both the outer shell 12 and the inner shell 22 have openings on their top ends 18, 28 and their bottom ends 19, 30 (best seen in FIG. 6). The opening of the outer shell 12 defines an outer shell interior 20 therein (best seen in FIG. 6), and the opening of the inner shell 22 defines an inner shell interior 31 therein (best seen in FIG. 6). In an embodiment, the inner shell 22 may include one or more rings 40, each ring 40 having a circumferential opening 42 in its center, and having a diameter which is substantially the same but slightly less than the diameter of the inner shell 22. The one or more rings 40 are configured to fit inside and on the bottom end 30 of the inner shell 22 by resting on a circumferential shoulder located on the inner side 14 of the outer shell 12 (not shown). In another embodiment, the inner shell 22 has an adjustable aperture, or iris, at the bottom end 30 (not shown) in place of a ring.

The inner shell 22 is configured to fit inside the outer shell 12, and thus has a diameter that is less than the diameter of the outer shell 12. In an embodiment, the diameter of the inner shell is about 2.0 inches to about 4.0 inches smaller than the diameter of the outer shell. In another embodiment, the diameter of the inner shell is about 2.0 inches smaller than the diameter of the outer shell.

In an embodiment, the area between the outer end 26 of the inner shell 22 and the inner side 14 of the outer shell 12 is uncovered, i.e., open. In another embodiment, the area between the outer end 26 of the inner shell 22 and the inner side 14 of the outer shell 12 is covered, i.e., closed, with a closure made of wood or any other suitable material.

Figure 2:
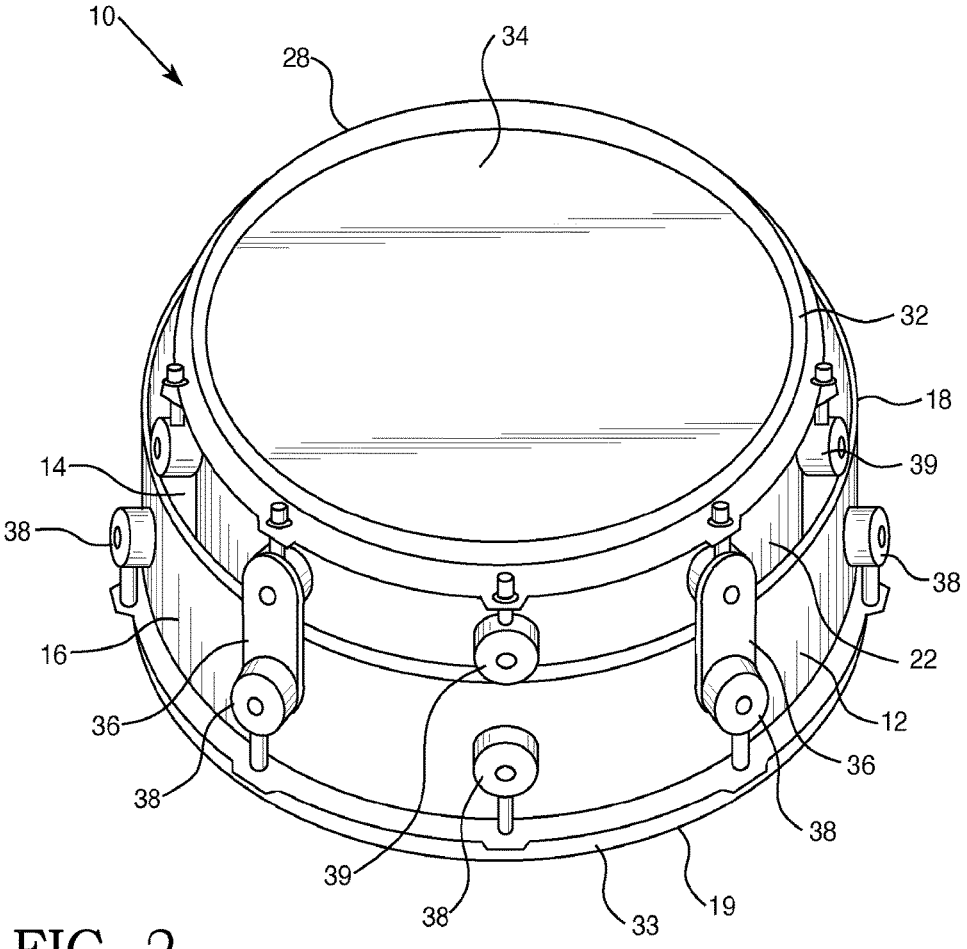
FIG. 2 is a perspective view of the dual shell drum which is fully assembled having eight lugs evenly spaced apart, in accordance with the embodiments of the invention.

As shown in FIGS. 1-2, the inner shell 22 and the outer shell 12 each have a circumferential rim 32, 33, respectively, which holds and provides tension to a membranous skin 34, referred to herein as a "membrane" "head" or "batter" (outer shell membranous skin not shown). The membranous skin typically, but not exclusively, is made from plastic. In an embodiment, one or both membranous skins are replaced with other materials such as, without limitation, plywood panels (commonly used in Cajon drums).

Figure 3:
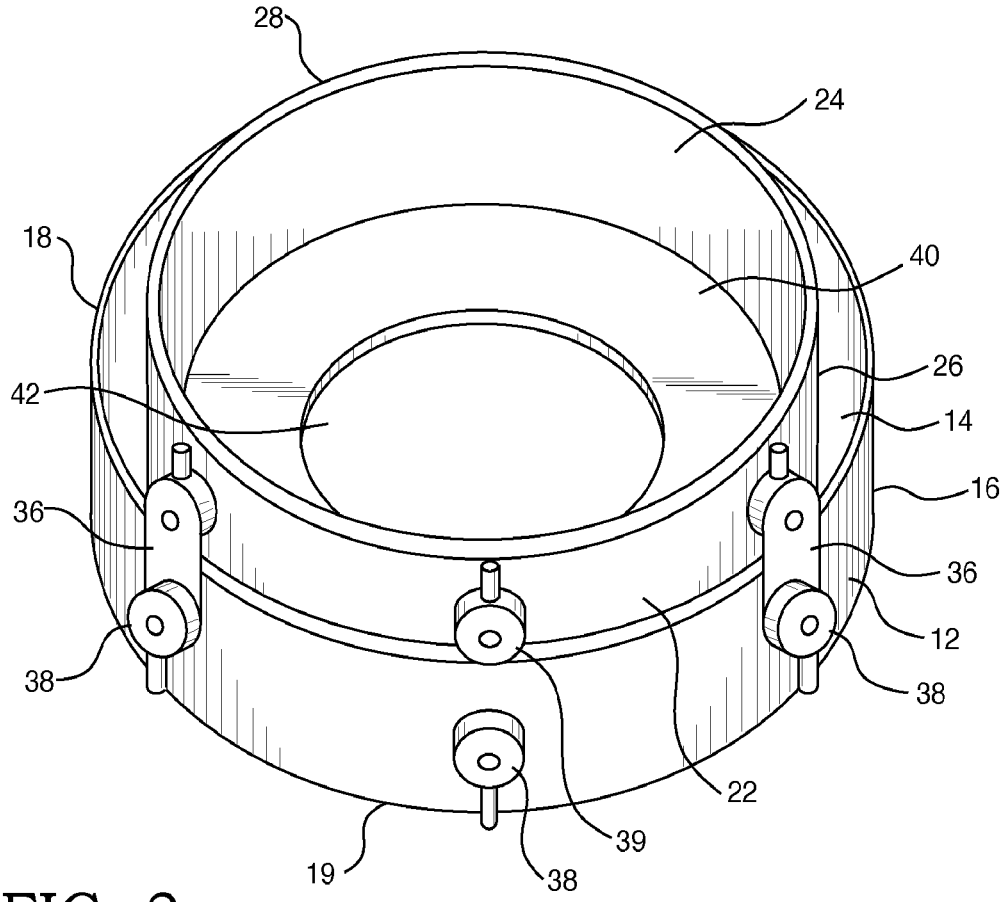
FIG. 3 is a perspective view of the dual shell drum partially disassembled having six lugs evenly spaced apart, in accordance with the embodiments of the invention.
Figure 4:
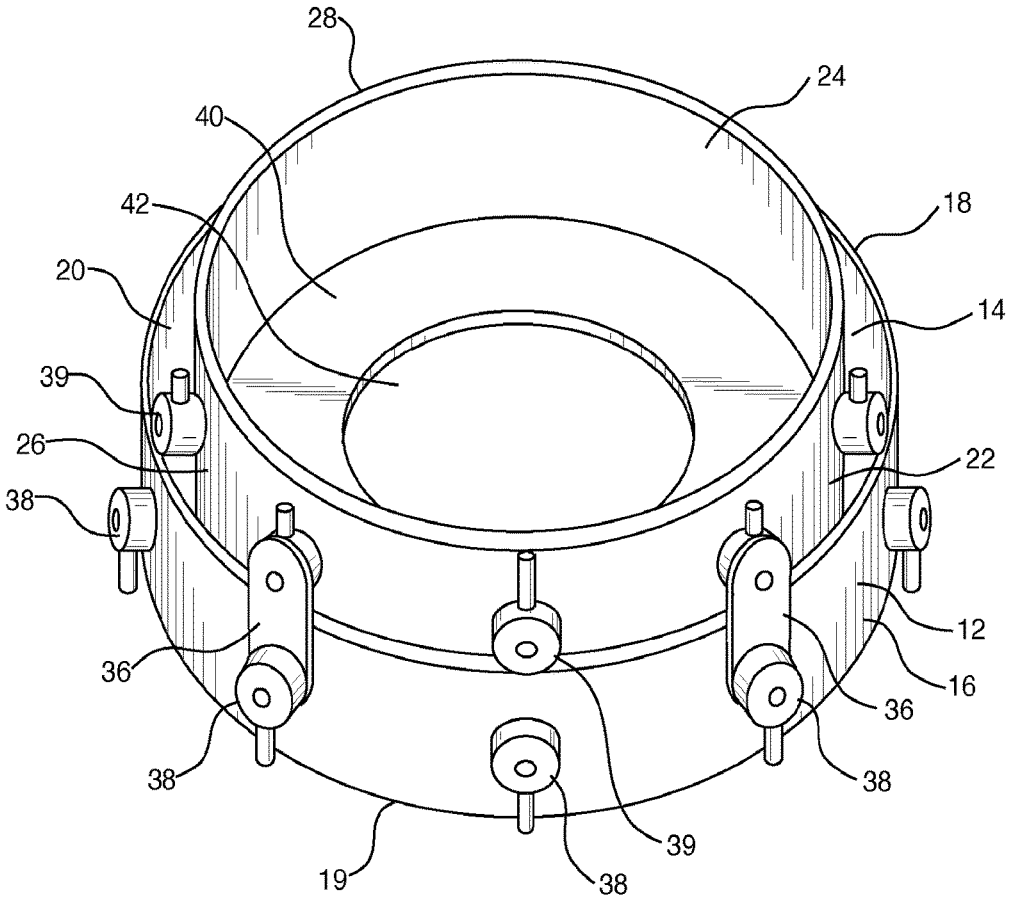
FIG. 4 is a perspective view of the dual shell drum partially disassembled having eight lugs evenly spaced apart, in accordance with the embodiments of the invention.
Figure 5:
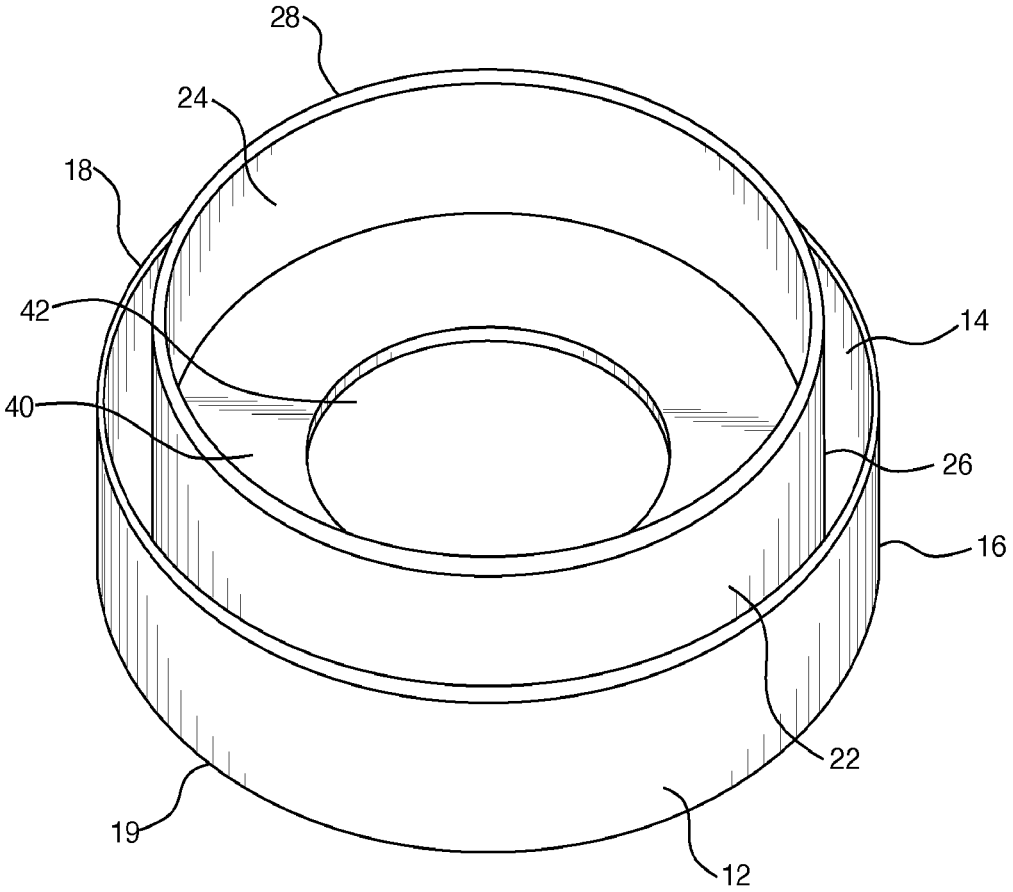
FIG. 5 is a perspective view of the dual shell drum showing the outer shell and the inner shell, in accordance with the embodiments of the invention.
Figure 6:
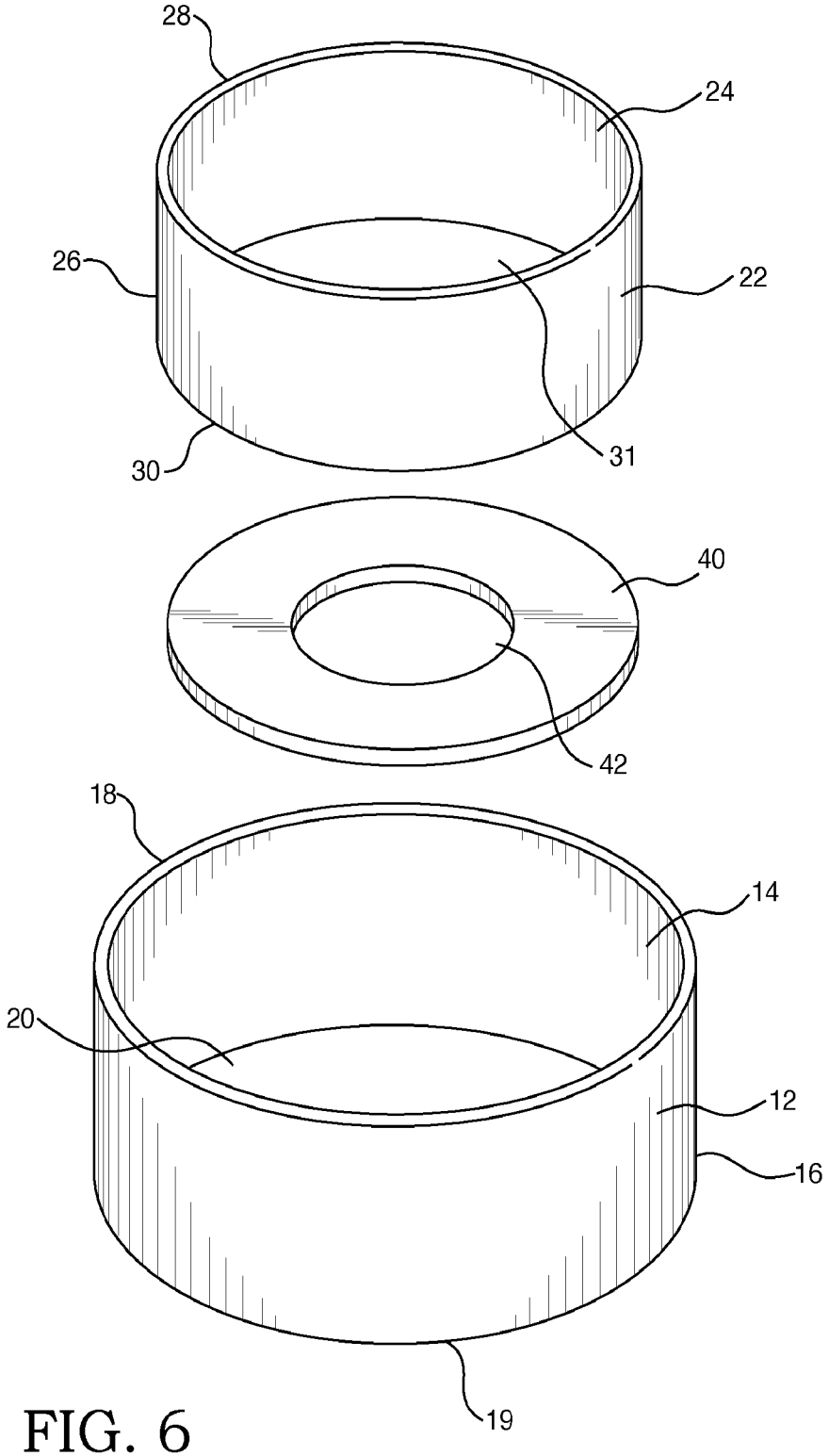
FIG. 6 is an exploded view of the dual shell drum showing the inner shell, the outer shell, and a ring which sits inside the inner shell, in accordance with the embodiments of the invention.

The outer side 16 of the outer shell 12 and the outer side 26 of the inner shell 22 each have a plurality of lugs 38, 39, respectively, to which lug brackets 36 are attached thereto in order to securely attach and suspend the inner shell 22 to the outer shell 12. The invention encompasses any other suitable means of suspending the inner shell 22 within the outer shell 14, so long as the bottom of the inner shell 22 does not touch the membranous skin of the outer shell 12. As shown in FIGS. 1 and 3, the dual shell drum 10 has an outer shell lug 38, an inner shell lug 39, and two lug brackets 36; and FIGS. 2 and 4 show a dual shell drum 10 having three outer shell lugs 38, three inner shell lugs 39, and two lug brackets 36.

In an embodiment, the suspension of the inner shell 22 above the outer shell 12 is fixed, i.e., is not adjustable. In another embodiment, the suspension of the inner shell 22 above the outer shell 12 is adjustable, i.e., can be adjusted vertically by adjusting the height to which the lug brackets 36 are attached to the outer and inner shell lugs 38, 39, respectively. In all cases, however, the inner shell 22 is suspended atop the outer shell 12 and does not touch the membranous skin of the outer shell 12.

Figure 7:
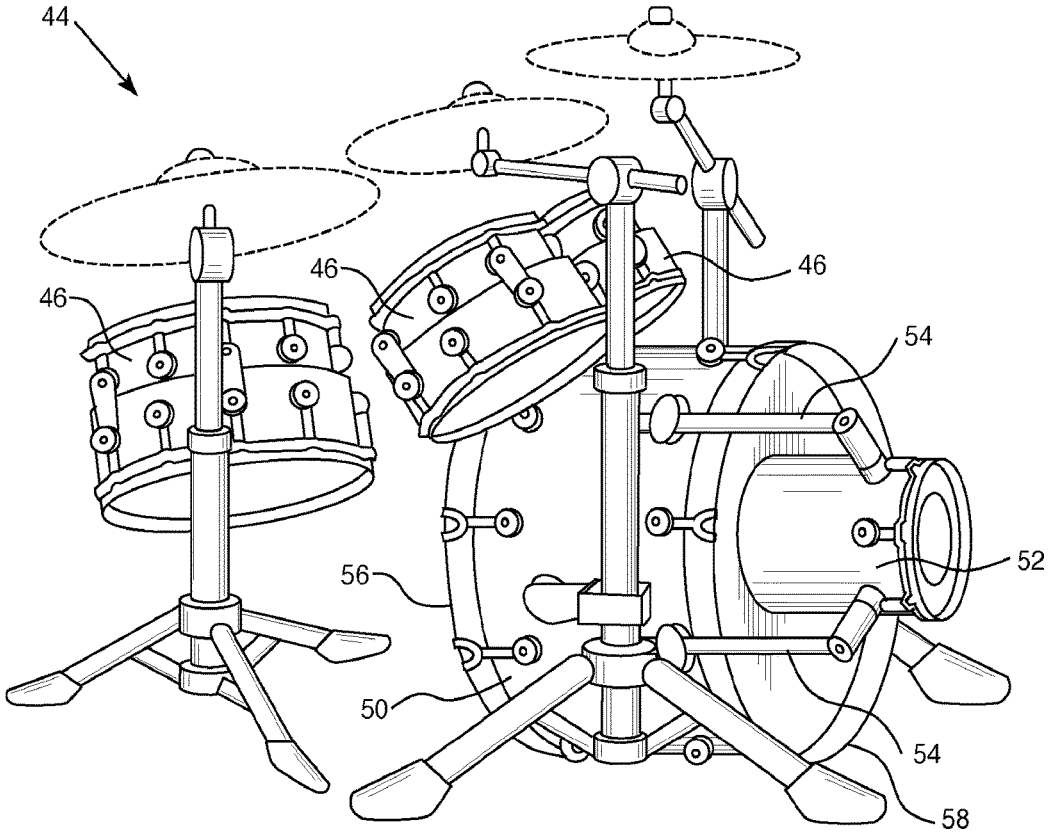
FIG. 7 is a perspective view of a drum set showing three dual shell tom drums: two rack toms and one floor tom; and a bass drum having a subwoofer attached to one end, in accordance with the embodiments of the invention.

FIG. 7 shows a drum set 44 comprised of three dual shell tom drums 46 and a bass drum 50. The bass drum 50 at its bottom end, or resonator end 58, has attached thereto a subwoofer 52. Any suitable attachment means is contemplated for use in the present invention, with attachment means for drum components of a drum set well known by those skilled in the art. In this embodiment, the bass drum 50 effectively has a secondary adjustable drum shell, i.e., the subwoofer 52, on the bottom end 58 which moves in and out of the bass drum 50. This is analogous to the dual shell configuration aesthetics described above.

Figure 8:
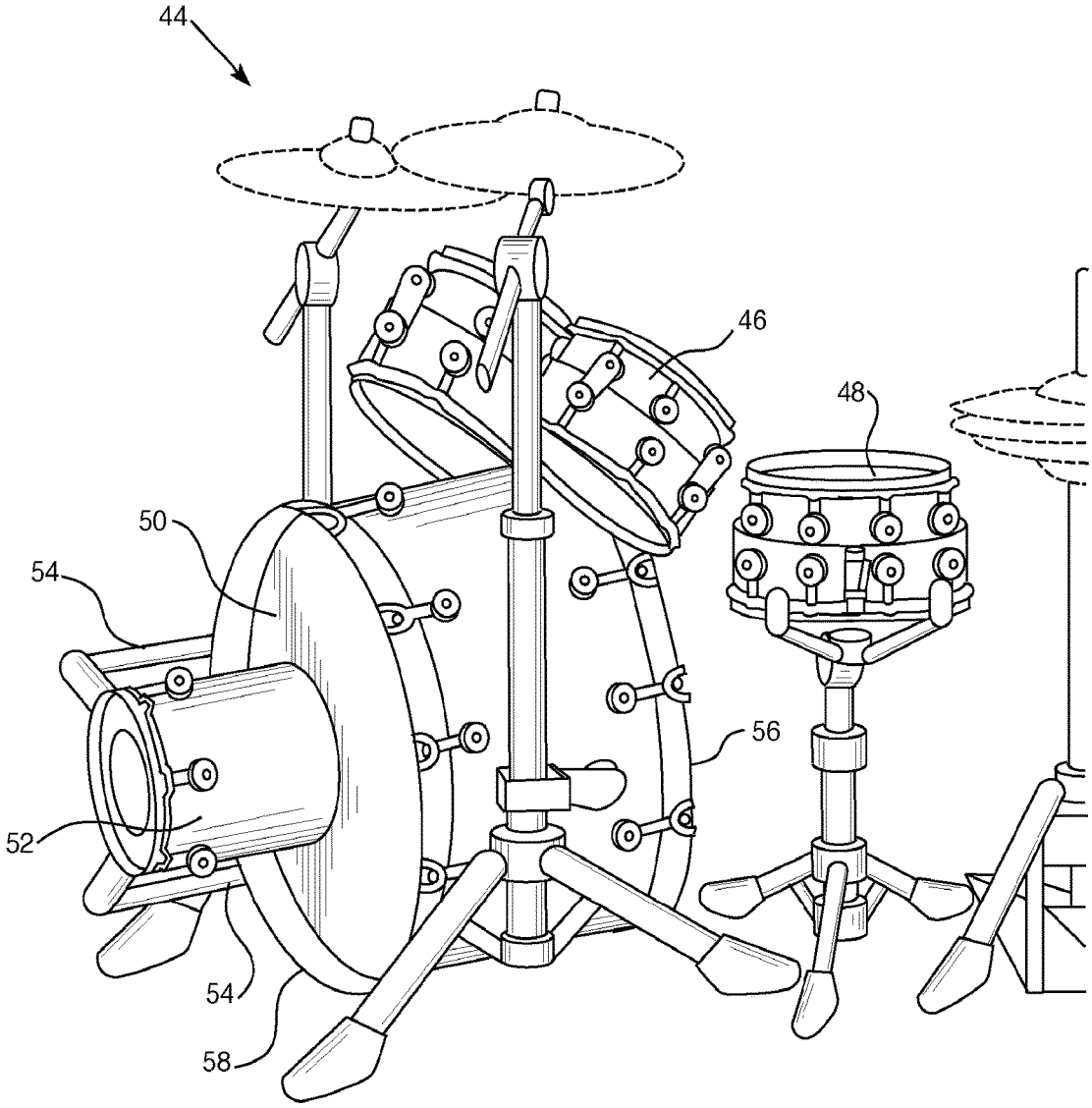
FIG. 8 is a perspective view of a drum set showing two dual shell tom drums, one dual shell snare drum, and a bass drum having a subwoofer attached to one end, in accordance with the embodiments of the invention.

FIG. 8 shows a drum set 44 comprised of two dual shell tom drums 46, one snare drum 48, and a bass drum 50 having a subwoofer 52 attached to its resonator end 58.

In both drum sets 44 shown in FIGS. 7 and 8, the full complement of mounting hardware for the dual shell drums are not shown. Any suitable mounting hardware commonly known and used by those skilled in the art may be used to mount the dual shell drums of the present invention.

In another embodiment, a speaker is substituted for the batter head of the inner shell of the dual shell drum and is used to amplify electronic drums, and thus the dual shell drum in combination with the speaker is capable of providing amplification to electronic drum sets.

The dimensions (depth and diameter) of the dual shell drum 10 of the invention depend on the type of drum configured in the dual shell configuration. Drums that may be configured in accordance with the dual shell design include, for example and without limitation, tom drums, snare drums, hand drums and the like.

The fully assembled dual shell drum 10 has a depth and a diameter that is determined as follows: the depth of the dual shell drum 10 is measured from the bottom end 19 of the outer shell 12 to the top end 18 of the outer shell 12; and the diameter of the dual shell drum 10 is determined by measuring the diameter of the outer shell 12.

With respect to tom drums, the depth of the fully assembled dual shell drum may range from about 3 inches to about 20 inches. In an embodiment, the depth of the tom drum is about 4.5 inches when the diameter of the outer shell is about 12 inches; about 5.5 inches when the diameter of the outer shell is about 14 inches, and about 6.5 inches when the diameter of the outer shell is about 16 inches.

With respect to snare drums, the depth of the fully assembled dual shell drum may range from about 2 inches to about 15 inches. In an embodiment, the depth of the snare drum is about 6 inches when the diameter is 15 inches.

With respect to bass drums, the dual shell bass drum has a diameter that ranges from about 16 inches to about 28 inches, and a depth that ranges from about 6 inches to about 12 inches. In an embodiment, the diameter is about 18 inches and the depth is about 10 inches.

It should be appreciated, however, that the dimensions of the compact dual shell design of the invention are not limited to such sizes, as the invention encompasses larger-sized dual shell drums when even more enhanced sound tone and projection are desired.

When the invention is used in a cocktail drum set configuration, the bass drum in the drum set is in an inverted, or upside-down configuration of the dual shell design shown in FIG. 1, i.e., the outer shell is atop the inner shell and the inner shell is suspended below the outer shell. This is because the bass drum is played on both sides in cocktail drum sets, with a kick pedal striking the bottom and the top is struck with drumsticks.

The inner and outer shells of the dual shell drum of the invention May be manufactured of wood, however, any suitable material commonly known and used by those skilled in the art may used to manufacture the inventive dual shell drum.

The inner and outer shells of the dual shell drum of the invention can be manufactured in various shapes, including, without limitation, conical- or tapered-shaped, goblet-shaped or bowl-shaped.

In use, the dual shell drums may be set up in a drum set using conventional hardware well known in the art, or using customized hardware, such as, without limitation, two cymbal stands that have only two legs each, and cymbal stand auxiliary mounting hardware fixed to the bass drum, which provides for a better rouge of positioning option of the drums, and ensures that the drum set will not move while being played or damage floors or carpet.

Further, the dual shell drum of the invention has a broader tonal range and superior sound quality compared to a conventional single shell drum. This is due to the heightened resonance produced from the dual shell configuration, which focuses air within the inner shell of the dual shell drum.

What is claimed is:

1. A drum, comprising:

a first shell having a first diameter;

a second shell having a second diameter that is different from the first diameter; and at least one lug having a linking member coupled to a first lug anchor disposed contiguous with the first shell and disposed apart from the second shell and coupled to a second lug anchor disposed contiguous with the second shell and disposed apart from the first shell.

2. The drum of claim 1, further comprising a batter head disposed contiguous with the first shell and disposed apart from the second shell.

3. The drum of claim 1, further comprising a resonator head disposed contiguous with the second shell and disposed apart from the first shell.

4. The drum of claim 1, wherein the diameter of the first shell is smaller than the diameter of the second shell.

5. The drum of claim 1, wherein the first shell and the second shell are concentrically aligned.

6. The drum of claim 1, wherein the first shell is disposed inside the second shell.

7. The drum of claim 1, wherein the first shell comprises a first depth and the second shell comprises a second depth that is different from the first depth.

8. The drum of claim 1, further comprising a plurality of lugs disposed about the first drum shell and the second drum shell wherein at least some of the drum lugs are set apart from at least one drum shell.

9. The drum of claim 1, further comprising an adjustable aperture disposed on one of the first and second drum shells.

10. The drum of claim 1, further comprising a ring disposed contiguous with the first shell and having a circumferential opening with a diameter less than the first diameter of the first shell.

11. A drum, comprising:

a first shell having a first diameter and a first depth;

a second shell having a second diameter that is different from the first diameter and having a first depth that is different from the second depth;

at least one batter head disposed contiguous with one and only one of the first and second drum shells; and at least one lug having a linking member coupled to a first lug anchor disposed contiguous with the first shell and coupled to a second lug anchor disposed contiguous with the second shell.

12. The drum of claim 11, further comprising a resonator head disposed contiguous with the second shell.

13. The drum of claim 11, wherein the diameter of the first shell is smaller than the diameter of the second shell.

14. The drum of claim 11, wherein the first shell and the second shell are concentrically aligned.

15. The drum of claim 11, wherein the first shell is disposed inside the second shell.

16. The drum of claim 11, wherein the first shell comprises a first depth and the second shell comprises a second depth that is smaller from the first depth.

17. The drum of claim 11, further comprising a plurality of lugs disposed about the first drum shell and the second drum shell wherein at least some of the drum lugs are set apart from at least one drum shell.

18. The drum of claim 11, further comprising an adjustable aperture disposed on one of the first and second drum shells.

19. The drum of claim 11, further comprising a ring disposed contiguous with the first shell and having a circumferential opening with a diameter less than the first diameter of the first shell.

* * * * *